US009513077B2

(12) United States Patent
Noro et al.

(10) Patent No.: US 9,513,077 B2
(45) Date of Patent: Dec. 6, 2016

(54) MAGAZINE LOCK AND PORTABLE FIREARM

(71) Applicant: HOWA MACHINERY, LTD., Kiyosu-shi, Aichi (JP)

(72) Inventors: Kazutoshi Noro, Kiyosu (JP); Takao Murase, Kiyosu (JP)

(73) Assignee: HOWA MACHNERY, LTD., Kiyosu-Shi (JP)

( * ) Notice: Subject to any disclaimer, the term of this patent is extended or adjusted under 35 U.S.C. 154(b) by 0 days.

(21) Appl. No.: 14/759,840

(22) PCT Filed: Jan. 11, 2013

(86) PCT No.: PCT/JP2013/050478

§ 371 (c)(1),
(2) Date: Jul. 8, 2015

(87) PCT Pub. No.: WO2014/109060

PCT Pub. Date: Jul. 17, 2014

(65) Prior Publication Data

US 2015/0338180 A1 Nov. 26, 2015

(51) Int. Cl.

| | |
|---|---|
| ***F41A 17/38*** | (2006.01) |
| ***F41A 17/36*** | (2006.01) |
| ***F41A 19/11*** | (2006.01) |
| *F41A 9/69* | (2006.01) |

(52) U.S. Cl.

CPC ..... *F41A 17/36* (2013.01); *F41A 17/38* (2013.01); *F41A 19/11* (2013.01); *F41A 9/69* (2013.01)

(58) Field of Classification Search

CPC ..... F41A 9/61; F41A 9/65; F41A 9/69; F41A 17/36; F41A 17/38

USPC ..... 42/50

See application file for complete search history.

(56) References Cited

U.S. PATENT DOCUMENTS 1,044,983 A * 11/1912 Brown ..... F41A 9/65 42/50

2,386,722 A 10/1945 Sefried (Continued)

FOREIGN PATENT DOCUMENTS

WO WO 95/02799 * 1/1995

OTHER PUBLICATIONS

English-language International Search Report from the Japanese Patent Office, for International Application No. PCT/JP2013/050478, mailed Apr. 23, 2013.

*Primary Examiner* — Stephen M Johnson

(74) *Attorney, Agent, or Firm* — Finnegan, Henderson, Farabow, Garrett & Dunner, L.L.P.

(57) ABSTRACT

A magazine attachment/detachment mechanism (10) is equipped with; protrusions (11*a*, 11*b*) extending downward from a receiver (2); and an attachment/detachment unit (12) that is movably attached to the protrusions (11*a*, 11*b*) and that attaches a magazine (3) to the receiver (2) in a detachable manner. The attachment/detachment unit (12) attaches/detaches the magazine (3) to/from the receiver (2) by moving between a securing position that secures the magazine (3) and a release position that releases the magazine (3). Thus, the magazine (3) is attached directly to the receiver (2), so deviation from the design value for the attachment height of the magazine (3) with respect to the receiver (2) can be reduced. Accordingly, it is possible to prevent defects in the chambering of cartridges without reducing the strength of the receiver (2).

6 Claims, 7 Drawing Sheets

(56) References Cited

U.S. PATENT DOCUMENTS 2,715,355 A * 8/1955 Garand ..... F41A 19/46 89/140
2,956,363 A 10/1960 Montana
3,019,542 A * 2/1962 Manthos ..... F41A 9/65 42/18
3,235,994 A 2/1966 Grippo
3,584,533 A 6/1971 Allyn
3,619,929 A * 11/1971 Fremont ..... F41A 9/69 42/50
3,711,983 A 1/1973 Allyn
4,056,038 A * 11/1977 Rath ..... F41A 5/18 42/16
5,899,013 A * 5/1999 Hauser ..... F41A 17/38 42/6
8,104,209 B1 * 1/2012 Bentley ..... F41A 9/59 42/49.01
2011/0010977 A1 1/2011 Cash et al.

* cited by examiner

MAGAZINE LOCK AND PORTABLE FIREARM

TECHNICAL FIELD

The present invention relates to a magazine look for attaching and detaching a magazine with respect to a firearm receiver. Further, the present invention relates to a portable firearm which is provided with such a magazine lock.

BACKGROUND ART

An automatic portable firearm is provided with a magazine in which a number of cartridges are held. The magazine is usually attached to the bottom side of the firearm receiver at the rear part of the barrel. It is desirable that the magazine can be attached and detached with respect to the portable firearm to quickly reload the cartridges. In this case, the portable firearm, as shown in PLT 1, is provided with a magazine lock.

CITATIONS LIST

Patent Literature

PLT 1: U.S. Pat. No. 5,899,013

SUMMARY OF INVENTION

Technical Problem

The cartridges in the magazine are biased upward by a spring and abut against the top part of the magazine. In a so-called "bolt action" system, a bolt is slid forward in the firearm receiver to push the cartridge at the topmost part of the magazine to the muzzle side whereby the cartridge is loaded into the chamber for firing. If the height of attachment of the magazine to the firearm receiver is low, the contact area of the bolt and cartridge becomes smaller, so the bolt cannot push the cartridge at the topmost part of the magazine and in turn the cartridge jams.

As the method of holding a large number of cartridges in a magazine, the system called the "double column-double feed" system is known. In the double column-double feed system, as shown in FIG. 14, two columns of cartridges are alternately stacked in the magazine in a partially overlapping state. The cartridges of the different columns are alternately fed from the magazine into the chamber. With this system, the dead space in the magazine can be made smaller, so the magazine can hold more cartridges.

However, with the double column-double feed system, the center of the bolt and the center of a cartridge are offset in the direction vertical to the stacking direction of the cartridges (left-right direction of FIG. 14), so the contact area between the bolt and the cartridge becomes smaller. For this reason, a cartridge easily jams, so the allowable deviation of the height of attachment of the magazine to the firearm receiver from the design value is smaller.

Usually, at the time of assembly, the firearm receiver and a trigger guard are attached to the stock. In other words, the trigger guard is positioned with respect to the firearm receiver via the stock. In the magazine lock which is described in PLT 1, the magazine is attached to the trigger guard by a lever and pin which are arranged before and after the magazine. Therefore, the magazine is positioned with respect to the firearm receiver via the trigger guard and stock. For this reason, the height of attachment of the magazine to the firearm receiver can deviate from the design value by the amounts of tolerance of the parts of the stock and trigger guard. As explained above, if the height of attachment of the magazine with respect to the firearm receiver is low, a cartridge can jam.

If, to prevent jamming of a cartridge, strictly limiting the tolerances of the parts of the stock and trigger guard, the unit costs of the parts of the stock and trigger guard will increase. Further, if setting a threshold value of the height of attachment of the magazine to the firearm receiver and separating out defective products in the assembly process of the portable firearm, the man-hours required will increase and therefore the manufacturing costs will increase and the mass production effect will fall.

As another method for preventing jamming of a cartridge, it is known to provide a projection at the bottom part of the bolt so as to make the contact area of the bolt and the cartridge increase. In this case, it is necessary to provide a groove for the passage of the projection of the bolt at the inside surface of the firearm receiver. This causes the thickness of the firearm receiver to decrease and in turn causes a drop in the strength of the firearm receiver. The firearm receiver also has the role of receiving the recoil when a cartridge is fired. For this reason, if the strength of the firearm receiver is low, it is not possible to use high powered rounds like magnum rounds, so the types of cartridges which can be used become limited. Further, a special bolt at which the projection is provided and a special firearm receiver at which the groove is provided become necessary, so the firearm receiver and bolt and in turn the portable firearm become more expensive.

The present invention was made in consideration of the above situation and has as its object the provision of a magazine lock which decreases the deviation of the height of attachment of the magazine to the firearm receiver from the design value and thereby can prevent a cartridge from jamming without causing a decline in the strength of the firearm receiver.

Solution to Problem

In a first aspect of the present invention, there is provided a magazine lock which comprises projections which extend downward from a mesh firearm receiver and lock parts which are movably attached to the projections and attach and detach a magazine with respect the firearm receiver, wherein the lock parts move between a fastening position where they fasten the magazine and a release position where they release the magazine so as to attach and detach the magazine. Note that the firearm receiver side of the magazine lock is defined as the "top" side of the magazine lock, while the opposite side from the firearm receiver along the short direction of the bash firearm receiver is defined as the "bottom" side of the magazine lock.

In the first aspect of the present invention, preferably the magazine is a double column-double feed type of magazine.

In the first aspect of the present invention, preferably the lock parts include two engagement members which engage with the front side and rear side of the magazine.

Note that the muzzle side of the firearm receiver is defined as the "front" side of the magazine lock, while the opposite side from the muzzle along the longitudinal direction of the breech fire rm receiver is defined as the "rear" side of the magazine lock.

In the first aspect of the present invention, preferably the magazine lock further comprises a link mechanism which links the two engagement members, and the link mechanism makes the two engagement members simultaneously move between the fastening position and the release position.

In a second aspect of the present invention, there is provided a portable firearm which is provided with a magazine lock of the first aspect of the present invention.

In the second aspect of the present invention, preferably the portable firearm includes a trigger guard which is positioned with respect to the magazine lock via the stock and firearm receiver, and the trigger guard has an access hole which enables the lock part to be directly accessed from the bottom side of the trigger guard.

Advantageous Effects of Invention

According to the present invention, it is possible to provide a magazine lock which can reduce the deviation of the height of attachment of the magazine to the breech firearm receiver from the design value and thereby prevent a cartridge from jamming without lowering the strength of the firearm receiver, Below, the present invention will be much more sufficiently understood from the description of the preferred embodiments of the present invention and the attached drawings.

DESCRIPTION OF EMBODIMENTS

Below, referring to the attached drawings, an embodiment of the present invention will be explained. Further, in the attached drawings, the same components are assigned the same reference notations.

First, referring to FIG. 1 to FIG. 5 and FIG. 12 to FIG. 14, the mechanism by which a cartridge which is held in the magazine is loaded into the chamber for firing will be briefly explained.

Figure 1:
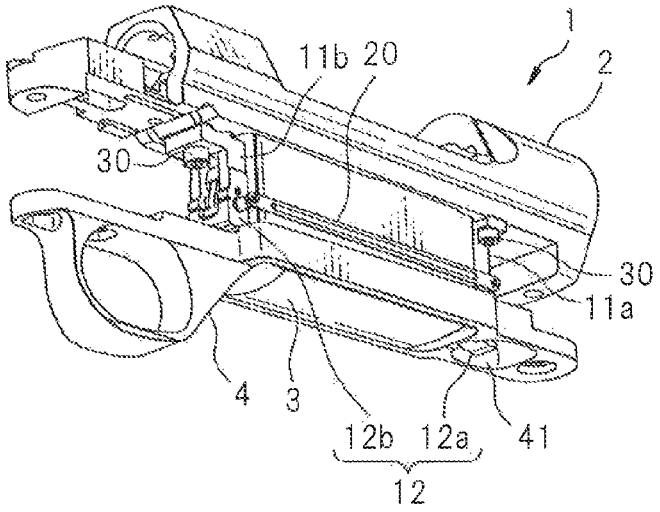
FIG. 1 is a partial perspective view of a portable firearm which is provided with a magazine lock according to the present invention.
Figure 2:
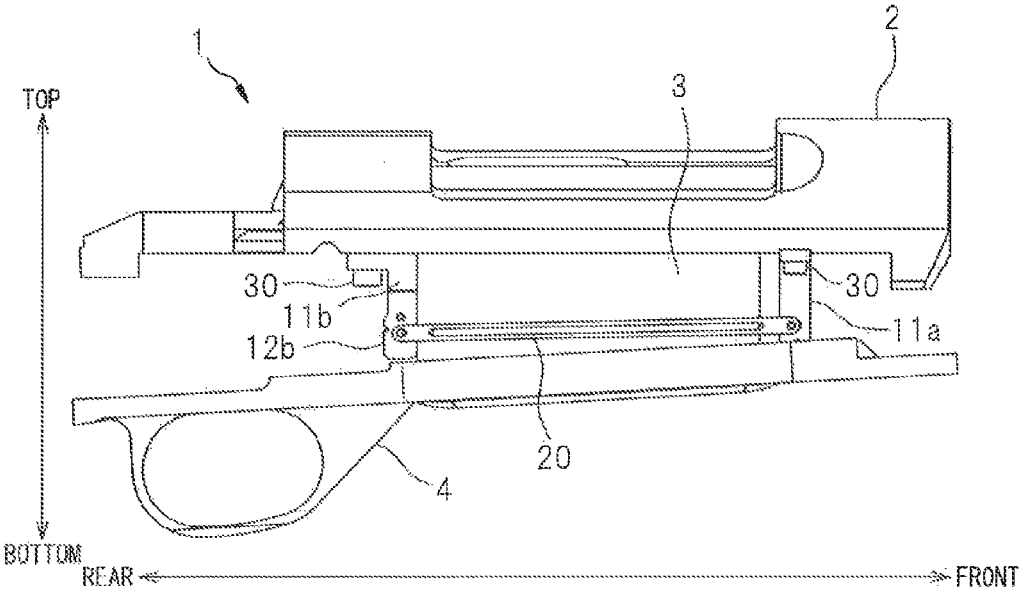
FIG. 2 is a partial front view of a portable firearm which is provided with a magazine lock according to the present invention.
Figure 3:
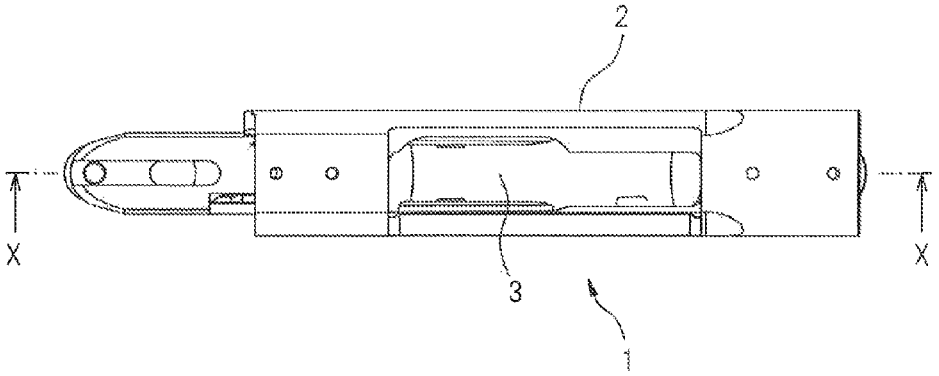
FIG. 3 is a partial plan view of a portable firearm which is provided with a magazine lock according to the present invention.
Figure 9:
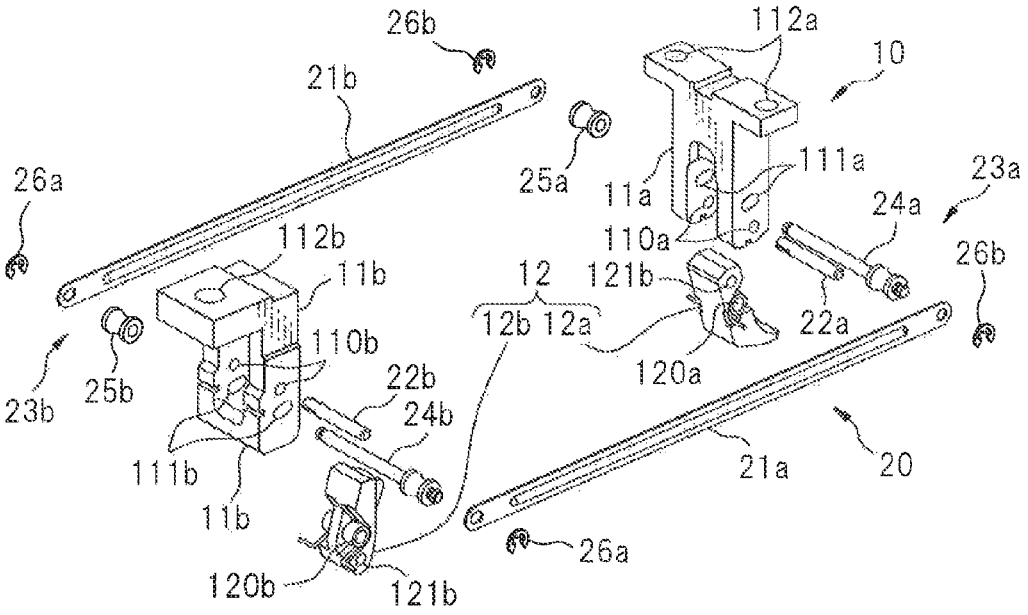
FIG. 9 is a disassembled perspective view of a magazine lock according to the present invention.

FIG. 1 to FIG. 3 are respectively a partial perspective view, a partial front view, and a partial plan view of a portable firearm 1 which is provided with a magazine lock 10 according to the present invention (see FIG. 9). FIG. 1 and FIG. 2 show a firearm receiver 2, a magazine 3 which is attached by the magazine lock 10 to the bottom side of the firearm receiver 2, and a trigger guard 4 which is arranged so as to surround the bottom part of the magazine 3. Details of the magazine lock 10 will be explained later.

Figure 4:
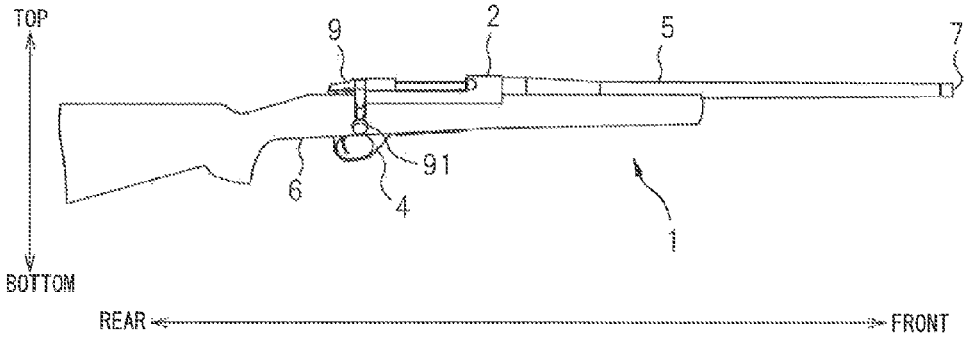
FIG. 4 is a front view of a portable firearm according to the present invention.

FIG. 4 is a front view of a portable firearm 1 according to the present invention. In FIG. 4, as an example of the portable firearm 1, a rifle 1 is shown. The firearm receiver 2 is arranged at the rear of the barrel 5. The magazine 3 is attached to the bottom side of the firearm receiver 2 and is held inside a stock 6. The trigger guard 4 is attached to the stock 6 and is positioned with respect to the magazine lock 10 via the stock 6 and firearm receiver 2. Note that, as shown in FIG. 2 and FIG. 4, in the Description, the muzzle 7 sides of the portable firearm 1 and firearm receiver 2 are defined as the "front" sides of the portable firearm 1 and magazine lock 10, while the sides opposite to the muzzle 7 along the longitudinal direction of the portable firearm 1 and firearm receiver 2 are defined as the "rear" sides of the portable firearm 1 and magazine lock 10. Further, the firearm receiver 2 sides of the portable firearm 1 and magazine lock 10 are defined as the "top" sides of the portable firearm 1 and magazine lock 10, while the sides opposite to the firearm receiver 2 along the short direction of the portable firearm 1 and firearm receiver 2 are defined as the "bottom" sides of the portable firearm 1 and magazine lock 10.

Figure 5:
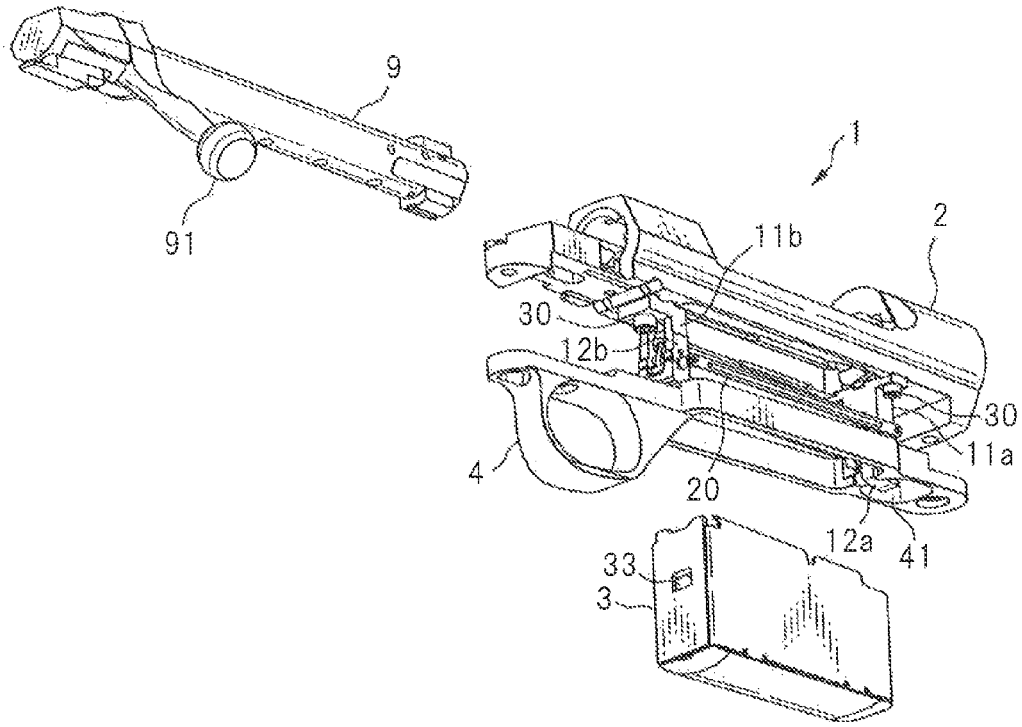
FIG. 5 is a disassembled perspective view of part of a portable firearm according to the present invention.

FIG. 5 is a disassembled perspective view of part of the portable firearm 1 according to the present invention. As shown in FIG. 5, the magazine 3 can be detached from the body of the portable firearm by the magazine lock 10. By doing this, an empty magazine and another magazine in which cartridges are loaded can be switched, so a large number of cartridges can be quickly reloaded.

Figure 12:
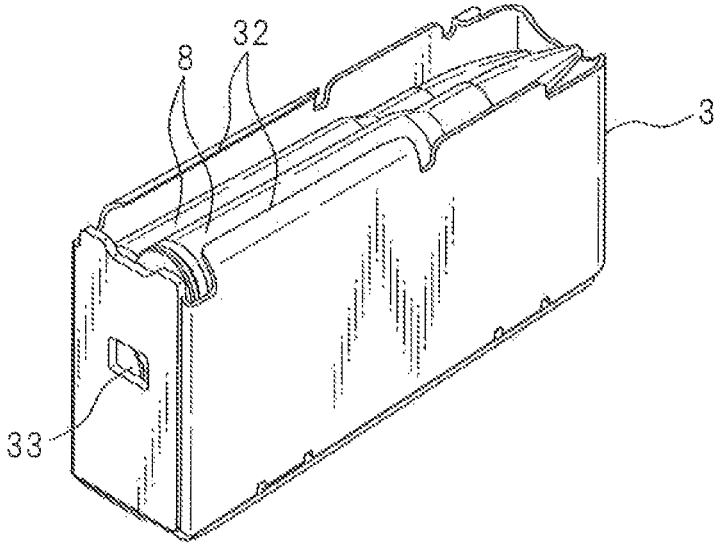
FIG. 12 is a perspective view of a magazine in which cartridges are held.
Figure 13:
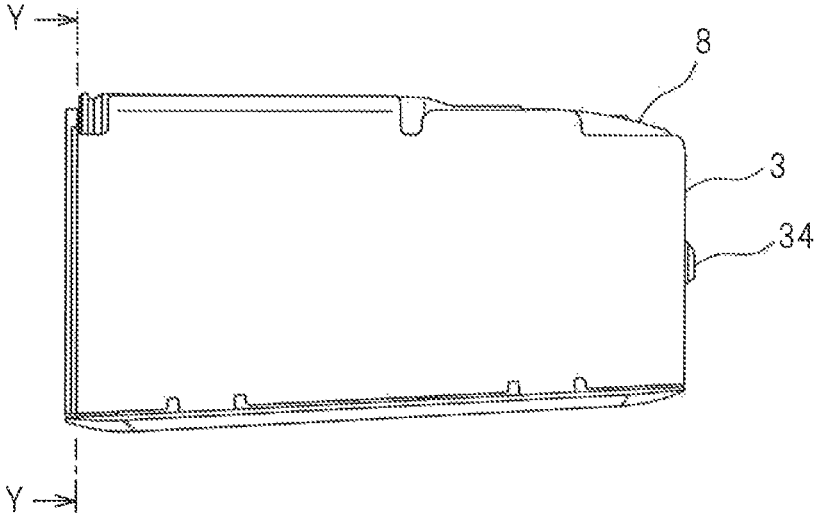
FIG. 13 is a front view of a magazine in which cartridges are held.
Figure 14:
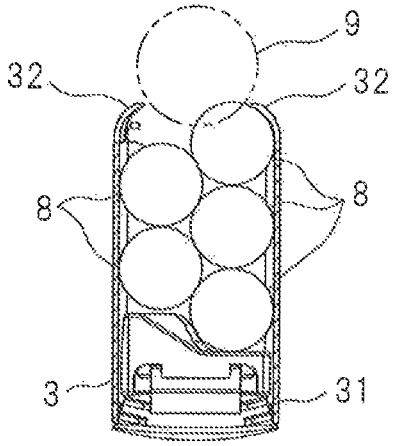
FIG. 14 is a cross-sectional view along the line Y-Y of FIG. 13.

FIG. 12 and FIG. 13 are respectively a perspective view and front view of a magazine 3 in which cartridges 8 are held. FIG. 14 is a cross-sectional view along the line Y-Y of FIG. 13. The system of holding cartridges 8 which is shown in FIG. 12 to FIG. 14 is called a "double column-double feed" system. In the double column-double feed system, as shown in FIG. 14, two columns of cartridges 8 are alternately stacked in the magazine 3 in a partially overlapping state. The cartridges 8 of the different columns are alternately fed from the magazine 3 into the chamber. With this system, the dead space in the magazine 3 can be made smaller, so the magazine 3 can hold more cartridges 8.

In a so-called "bolt action" system, a bolt 9 is slid forward in the firearm receiver 2 to push the cartridge 8 at the topmost part of the magazine 3 to the muzzle 7 side whereby the cartridge 8 is loaded into the chamber for firing. The shape of the bolt 9 is shown best in FIG. 5. A user can operate a handle 91 of the bolt 9 to make the bolt 9 move back and forth inside the firearm receiver 2. When the bolt 9 is slid forward in the firearm receiver 2 and passes over the magazine 3, as shown in FIG. 14, the bolt 9 and the cartridge 8 at the topmost part inside the magazine 3 come into contact, so the cartridge 8 at the topmost part is pushed by the bolt 9 and loaded from the magazine 3 to the chamber. After that, in the magazine 3, a cartridge 8 of a different column from the cartridge 8 which was loaded is biased upward by a spring 31 which is set at the bottom part of the magazine 3 and abuts against the top part 32 of the magazine 3.

After the cartridge is fired, the handle 91 is operated to make the bolt 9 retract whereby the spent round is ejected. If again sliding forward the bolt 9, the other cartridge 8 at the topmost part in the magazine 3 is loaded into the chamber. In this way, by back and forth motion of the bolt 9, it becomes possible to continuously fire rounds without hand loading a cartridge 8 into the magazine 3 each time.

Next, the magazine lock 10 according to the present invention will be explained in detail.

Figure 6:
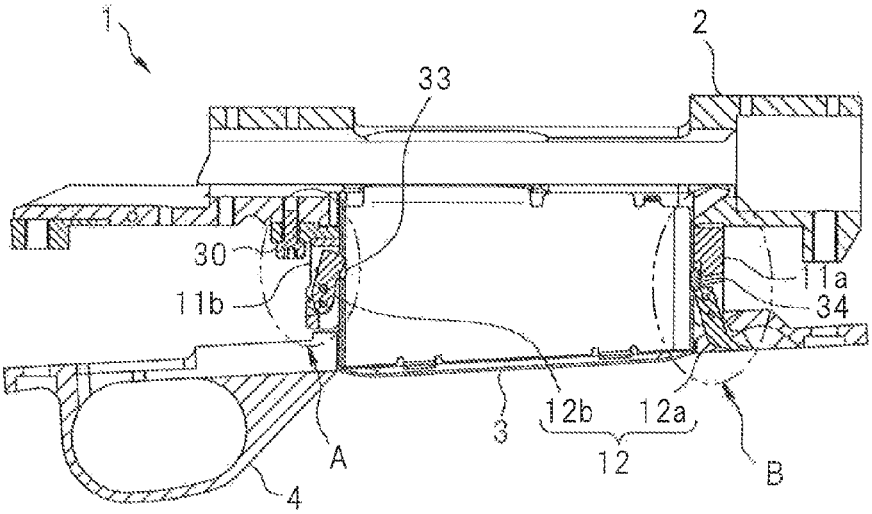
FIG. 6 is a cross-sectional view along the line X-X of FIG. 3.

FIG. 6 is a cross-sectional view along the line X-X of FIG. 3. FIG. 9 is a disassembled perspective view of the magazine lock 10. As shown in FIG. 6 and FIG. 9, the magazine lock 10 is provided with projections 11*a*, 11*b* which extend downward from the firearm receiver 2 and lock parts 12 which are movably attached to the projections 11*a* and 11*b* and attach and detach the magazine 3 with respect to the firearm receiver 2. The lock parts 12, as explained later, can move between a fastening position where they fasten the magazine 3 with respect to the firearm receiver 2 and a release position where they release the magazine 3. Due to this, the magazine 3 can be attached and detached with respect to the firearm receiver 2. The projections 11*a*, 11*b*, as shown in FIG. 1, are fastened to the firearm receiver 2 by bolts 30 in this embodiment, but may also be formed integrally with the firearm receiver 2.

In the present invention, the magazine 3 is directly fastened by the magazine lock 10 to the firearm receiver 2. Due to this, in the present invention, the tolerance of the parts of the stock 6 and trigger guard 4 does not affect at all to the height of attachment of the magazine 3 with respect to the firearm receiver 2. Therefore, it is possible to make the deviation of the height of attachment of the magazine 3 with respect to the 14 firearm receiver 2 from the design value decrease. For this reason, even if the magazine 3 is a double column-double feed system magazine, there is no need to provide a projection of the bolt 9 and a groove of the firearm receiver 2. Therefore, it is possible to prevent a cartridge 8 from jamming without causing the strength of the firearm receiver 2 to decrease. Due to this, the portable firearm can use high powered rounds like magnum rounds as cartridges 8.

Figure 10:
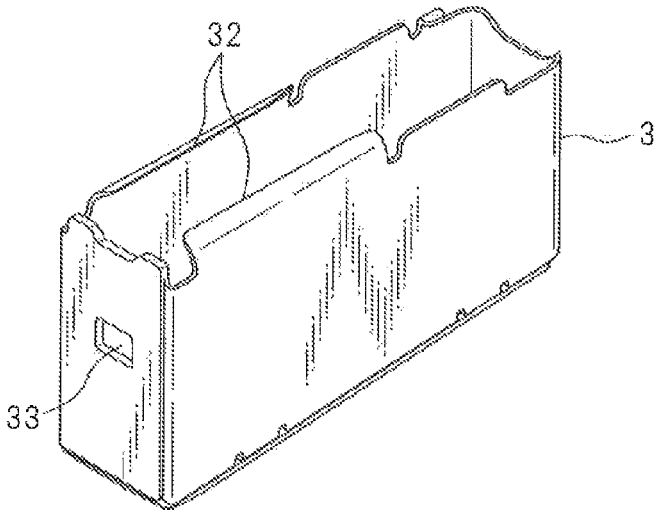
FIG. 10 is a perspective view which shows a rear side of a magazine.
Figure 11:
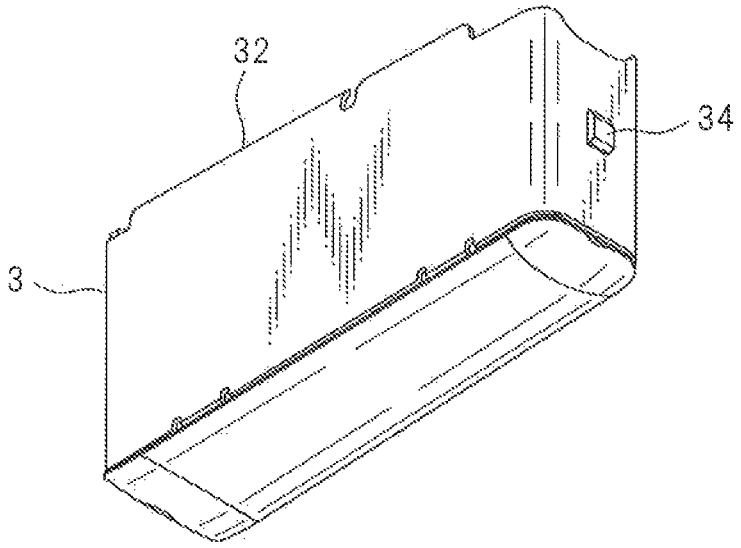
FIG. 11 is a perspective view which shows a front side of a magazine.

The lock parts 12 include two engagement members 12*a*, 12*b* which respectively engage with a front side and rear &de of the magazine 3. FIG. 10 and FIG. 11 are respectively perspective views which show the rear side and front side of the magazine 3. At the rear side of the magazine 3, a hole 33 is provided for the rear side engagement member 12*b* to engage with, while at the front side of the magazine 3, a projecting part 34 is provided for the front side engagement member 12*a* to engage with. As shown in FIG. 6, the two engagement members 12*a*, 12*b* respectively engage with the front side projecting part 34 and the rear side hole 33 of the magazine 3, whereby the magazine 3 is fastened with respect to the firearm receiver 2. By fastening the both sides of the front side and the rear side, compared with fastening one side of the front side or the rear side, the magazine 3 can be fastened more strongly with respect to the firearm receiver 2. Due to this, after attachment of the magazine 3, the magazine 3 is kept from descending from the firearm receiver 2 due to vibration etc. Note that, the engagement parts of the magazine 3 may both be holes or projecting parts or may be other shapes such as recesses.

Figure 7:
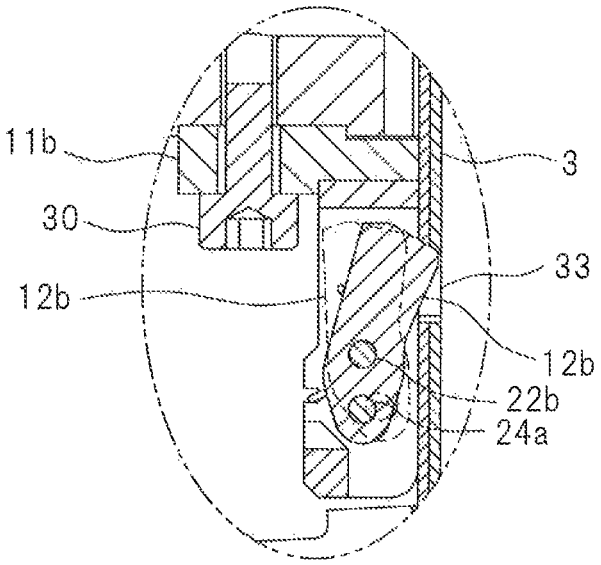
FIG. 7 is an enlarged view of a part A of FIG. 6.
Figure 8:
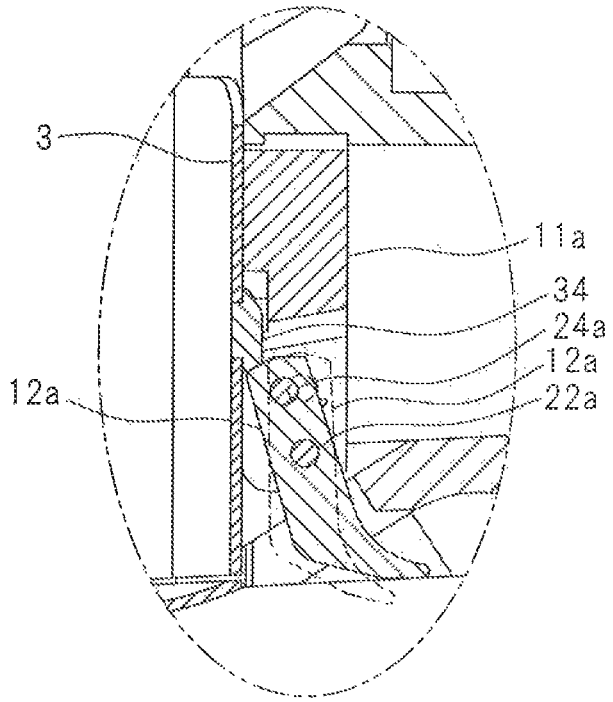
FIG. 8 is an enlarged view of a part B of FIG. 6.

FIG. 7 and FIG. 8 are respectively enlarged views of the part A and part B of FIG. 6. In FIG. 7 and FIG. 8, the engagement members 12*a*, 12*b* which have been made to move to a release position where they release the magazine 3 are shown by broken ones. As shown in FIG. 7 and FIG. 8, the two engagement members 12*a*, 12*b* respectively move between the fastening position (solid lines) where they fasten the magazine 3 and the release position (broken lines) where they release the magazine 3 and thereby can attach and detach the magazine 3 with respect to the firearm receiver 2. Note that the mode of movement of the engagement members 12*a*, 12*b* is not limited to rotational motion such as in the embodiment and may also be translational motion.

As shown in FIG. 2 and FIG. 9, the magazine lock 10 is preferably further provided with a link mechanism 20 which links the two engagement members 12*a*, 12*b*. The link mechanism 20 can, by the later explained configuration, make the two engagement members 12*a*, 12*b* simultaneously move between the fastening position and the release position. By doing this, it is possible to make only the one engagement member 12*a* move and thereby easily detach the magazine 3.

Below, the link mechanism 20 will be explained in detail.

As shown in FIG. 9, the link mechanism 20 is provided with two elongated links 21*a*, 21*b* which link the two engagement members 12*a*, 12*b*, two pins 22*a*, 22*b* which serve as rotation center axes for the engagement members, and two sets of connecting members 23*a*, 23*b* which connect the links 21*a*, 21*b* with the engagement members 12*a*, 12*b*. The connecting members 23*a*, 23*b* are provided with guide bars 24*a*, 24*b* which extend inside the engagement members 12*a*, 12*b* and the projections 11*a*, 11*b*, collars 25*a*, 25*b* which receive the guide bars 24*a*, 24*b* outside of the projections 11*a*, 11*b*, and two snap rings 26*a*, 26*b* which fasten the two ends of the guide bars to the link. At the projections 11*a*, 11*b*, holes 110*a*, 110*b* through which the pins 22*a*, 22*b* pass, long holes 111*a*, 111*b* through which the guide bars 24*a*, 24*b* pass and which limit the range of movement of the engagement members 12*a*, 12*b*, and bolt holes 112*a*, 112*b* through which the bolts 30 pass are provided. The engagement members 12*a*, 12*b* are also provided with holes 120*a*, 120*b* through which the pins 22*a*, 22*b* pass and holes 121*a*, 121*b* through which the guide bars 24*a*, 24*b* pass. The front side pin 22*a* and guide bar 24*a* and the rear side pin 22*b* and guide bar 24*b* are arranged at the top and bottom facing each other. More specifically, at the front side, the pin 22*a* is arranged at the bottom side from the guide bar 24*a*, while at the rear side, the pin 22*b* is arranged at the top side from the guide bar 24*b*. Due to this configuration, as explained later, the front side engagement member 12*a* and the rear side engagement member 12*b* simultaneously rotate in opposite directions due to the link mechanism 20.

The engagement members 12*a*, 12*b* are respectively attached to the projections 11*a*, 11*b* to be able to rotate about the pins 22*a*, 22*b*. As shown in FIG. 1, the bottom part of the front side engagement member 12*a* can be accessed from the access hole 41 of the trigger guard 4. For this reason, the front side engagement member 12*a* can be rotated by a finger from the bottom of the trigger guard 4.

As shown in FIG. 8, if pushing down the front side engagement member 12*a*, the front side engagement member 12*a* rotates together with the guide bar 24*a* clockwise about the pin 22*a*, so disengages from the projecting part 34 of the magazine 3. At this time, the links 21*a*, 21*b* which are fastened to the guide bar 24*a* move forward. Next, as shown in FIG. 7, the guide bar 24*b* which is fastened to the links 21*a*, 21*b* rotates together with the rear side engagement member 12*b* about the pin 22*b* counterclockwise. Due to this, the rear side engagement member 12*b* is disengaged from the hole 33 of the magazine 3. Therefore, the link mechanism 20 can make the two engagement members 12*a*, 12*b* move simultaneously between the fastening position and the release position. Further, if, in the state with the palm of the hand placed below the magazine 3, the finger of the same hand is used to push down the front side engagement member 12*a* through the access hole 41 of the trigger guard 4, the detached magazine 3 can be received by the palm of the hand. Therefore, the link mechanism 20 can be used to quickly detach the magazine 3 by a single hand.

Next, the method of attaching another magazine in which cartridges have been loaded after the empty magazine is detached will be explained. A magazine 3 is pushed into the body of the portable firearm by the palm of the hand from below the trigger guard 4. In that state, the front side engagement member 12*a* is pushed upward by a finger of the same hand through the access hole 41 of the trigger guard 4. If doing this, the two engagement members 12*a*, 12*b* are rotated from the release position to the fastening position. At this time, the front side engagement member 12*a* and the rear side engagement member 12*b* respectively engage with the projecting part 34 and hole 33 of the magazine, so the magazine 3 is fastened with respect to the firearm receiver 2. Therefore, the link mechanism 20 enables the magazine 3 to be quickly attached by a single hand.

The present invention has been explained based on a specific embodiment, but a person skilled in the art could make various changes, corrections, etc. without departing from the and concept of the present invention.

REFERENCE SIGNS LIST

1. portable firearm (rifle)
2. firearm receiver
3. magazine
31. spring
32. top part
33. hole
34. projecting part
4. trigger guard
41. access hole
5. barrel
6. stock
7. muzzle
8. cartridge
9. belt
91. handle
101. magazine lock
11*a*, 11*b*. projections
110*a*, 110*b*. holes
111*a*, 111*b*. long holes
112*a*, 112*b*. bolt holes
12. lock part
12*a*, 12*b*. engagement members
120*a*, 120*b*. holes
121*a*, 121*b*. holes
20. link mechanism
21*a*, 21*b*. links
22*a*, 22*b*. pins
23*a*, 23*b*. connecting members
24*a*, 24*b*. guide bars
25*a*, 25*b*. collars
26*a*, 26*b*. snap rings
30. bolt

The invention claimed is:

1. A magazine lock of a portable firearm comprising a barrel, a firearm receiver arranged at a rear of the barrel, a stock, and a trigger guard attached to the stock, the magazine lock comprising projections which extend downward from the firearm receiver and a lock part which is directly movably attached to the projections and attaches and detaches a magazine with respect the firearm receiver, wherein the lock part moves between a fastening position where the lock part fastens the magazine and a release position where the lock part releases the magazine so as to attach and detach the magazine.

2. The magazine lock according to claim 1 wherein said magazine is a double column-double feed type of magazine.

3. The magazine lock according to claim 1 wherein the lock part includes two engagement members which engage with a front side and a rear side of the magazine.

4. The magazine lock according to claim 3 wherein the magazine lock further comprises a link mechanism which links the two engagement members, and the link mechanism makes the two engagement members simultaneously move between the fastening position and the release position.

5. A portable firearm which is provided with a magazine lock according to any one of claims 1 to 4.

6. The portable firearm according to claim 5 wherein the trigger guard has an access hole which enables the lock part to be directly accessed from a bottom side of the trigger guard.

* * * * *